US010457301B2

(12) United States Patent
Alonso Garrido et al.

(10) Patent No.: US 10,457,301 B2
(45) Date of Patent: Oct. 29, 2019

(54) METHOD AND DEVICE FOR DETERMINING A SIGNAL ASPECT FOR A RAIL VEHICLE

(71) Applicant: SIEMENS MOBILITY GMBH, Munich (DE)

(72) Inventors: Oscar Alonso Garrido, Tres Cantos (ES); Pierre-Olivier Guislain, Chevreuse (FR); Christina Luebke, Rennau ot Ahmstorf (DE); Peter Luehrs, Braunschweig (DE); Steffen Ueckert, Lehrte (DE)

(73) Assignee: Siemens Mobility GmbH, Munich (DE)

( * ) Notice: Subject to any disclaimer, the term of this patent is extended or adjusted under 35 U.S.C. 154(b) by 109 days.

(21) Appl. No.: 15/556,321

(22) PCT Filed: Feb. 22, 2016

(86) PCT No.: PCT/EP2016/053648
§ 371 (c)(1),
(2) Date: Sep. 7, 2017

(87) PCT Pub. No.: WO2016/142160
PCT Pub. Date: Sep. 15, 2016

(65) Prior Publication Data

US 2018/0093683 A1 Apr. 5, 2018

(30) Foreign Application Priority Data

Mar. 12, 2015 (DE) ..... 10 2015 204 437

(51) Int. Cl.

| | |
|---|---|
| ***B61L 5/12*** | (2006.01) |
| ***B61L 3/02*** | (2006.01) |
| ***B61L 15/00*** | (2006.01) |
| ***B61L 25/02*** | (2006.01) |
| ***B61L 27/00*** | (2006.01) |
| ***B61L 23/04*** | (2006.01) |
| ***B61L 23/06*** | (2006.01) |

(52) U.S. Cl.
CPC ..... *B61L 5/125* (2013.01); *B61L 3/02* (2013.01); *B61L 15/0027* (2013.01); *B61L 23/041* (2013.01); *B61L 25/025* (2013.01); *B61L 27/0038* (2013.01); *B61L 23/06* (2013.01)

(58) Field of Classification Search
CPC ..... B61L 5/125; B61L 3/002; B61L 15/0027; B61L 23/041; B61L 23/06; B61L 25/025; B61L 27/0038
See application file for complete search history.

(56) References Cited

U.S. PATENT DOCUMENTS

| | | | | |
|---|---|---|---|---|
| 2002/0062181 | A1* | 5/2002 | Polivka | B61L 27/0038 701/19 |
| 2011/0315828 | A1* | 12/2011 | Bohlmann | B61L 1/187 246/167 R |
| 2013/0015296 | A1* | 1/2013 | Maurizio | B61L 1/188 246/122 R |
| 2014/0005863 | A1* | 1/2014 | Linares | B61L 15/0036 701/19 |
| 2014/0014783 | A1* | 1/2014 | Lude | B61L 1/187 246/122 R |
| 2014/0117168 | A1* | 5/2014 | Itagaki | B61L 1/10 246/34 R |
| 2014/0117169 | A1* | 5/2014 | Itagaki | B61L 1/10 246/34 R |
| 2015/0008294 | A1 | 1/2015 | Desbordes et al. | |
| 2015/0232110 | A1* | 8/2015 | Ghaly | B61L 27/0055 246/62 |
| 2016/0107665 | A1 | 4/2016 | Dommel | |
| 2016/0114820 | A1* | 4/2016 | Palmer | B61L 25/02 246/107 |
| 2018/0093683 | A1* | 4/2018 | Alonso Garrido | B61L 3/02 |
| 2018/0339721 | A1* | 11/2018 | Bresson | B61L 3/225 |
| 2019/0095725 | A1* | 3/2019 | Kalghatgi | B61L 3/008 |
| 2019/0144023 | A1* | 5/2019 | Gao | B61L 27/0016 |
| 2019/0144025 | A1* | 5/2019 | Gao | H04W 4/70 |

FOREIGN PATENT DOCUMENTS

| | | | | |
|---|---|---|---|---|
| CN | 102951185 | A | 3/2013 | |
| DE | 102013210063 | A1 | 12/2014 | |
| EP | 1942041 | A2 * | 7/2008 | B61L 15/0027 |
| EP | 1942041 | A2 | 7/2008 | |
| EP | 2527226 | A2 | 11/2012 | |
| WO | 2010139920 | A2 | 12/2010 | |

OTHER PUBLICATIONS

Shenton R., "Train Video Positioning", IRSE ASPECT 2008 Conference, Sep. 26, 2008 (Sep. 26, 2008), pp. 1-10, XP003029635.

* cited by examiner

*Primary Examiner* — Jason C Smith
(74) *Attorney, Agent, or Firm* — Laurence Greenberg; Werner Stemer; Ralph Locher

(57) ABSTRACT

A method for determining a signal aspect representing the vacant or occupied state of a track section for a rail vehicle, in particular a maintenance or construction vehicle, on a CBTC track. In this case, the rail vehicle does not have an on-board CBTC device. In order to dispense with special hardware, an app on a smartphone initiates the following steps: A) photographing of a track beacon in the direction of travel, B) determining the ID (identification signature) of the track beacon, C) transmitting of the track beacon ID to a CBTC track control center and D) receiving of the signal aspect determined by the CBTC track control center for the track section starting with the track beacon.

6 Claims, No Drawings

METHOD AND DEVICE FOR DETERMINING A SIGNAL ASPECT FOR A RAIL VEHICLE

BACKGROUND OF THE INVENTION

Field of the Invention

The invention relates to a method for determining a signal aspect representing the vacant or occupied state of a track section for a rail vehicle, in particular a maintenance or construction vehicle, on a CBTC—communication-based train control—track, wherein the rail vehicle does not have an on-board CBTC device, and a corresponding device.

In the case of CBTC tracks the movement authorities are transmitted to the on-board CBTC devices of the rail vehicles by radio. Track signals are not necessary. Running on the CBTC track is problematic if no on-board CBTC device is present in the rail vehicles. This relates in particular to maintenance vehicles and construction vehicles which do not regularly use the CBTC track.

So that even rail vehicles without an on-board CBTC device can run on the CBTC track, the following procedures are known:

1. The movement authority corresponding to the signal aspect or the refusal thereof is established and transmitted by verbal or written communication between a CBTC track control center and the vehicle driver. The vehicle drivers orient themselves using their knowledge of the track or on the basis of track markings such as kilometer signs and the like. For technical support of the orientation track-side radio balises can be provided according to EP 2 527 226 A2; these delimit individual track sections and enable the position of the rail vehicle to be determined as a prerequisite for a movement authority, in that the vehicle driver requests the position of the radio balise via a mobile device.
2. Another procedure is to install fixed signals or to erect mobile signals for the period during which the non-CBTC-compatible rail vehicle is running and for them to be controlled by the track control center.
3. In principle it is also possible to equip all maintenance and construction vehicles that are to run on the CBTC track with on-board CBTC equipment which is deactivated to the greatest possible extent.

These approaches are based on an extremely high hardware requirement or are at least in part sufficient only for specific decreased safety provisions.

SUMMARY OF THE INVENTION

The object of the invention is to eliminate these disadvantages, and to specify a method and a device of a generic type which enable signal aspect determination for a non-CBTC-compatible rail vehicle on a CBTC track with a low hardware requirement.

According to the method the object is achieved in that an app initiates the following steps on a smartphone:

A) Photographing a track balise located in the direction of travel,

B) Determining the ID—identification signature—of the track balise,

C) Sending the track balise ID to a CBTC track control center and

D) Receiving the signal aspect determined by the CBTC track control center for the track section starting with the track balise.

The object is achieved by a device in which an app that can be activated by means of a smartphone is provided for determining a track section on which to run based on a photographically recorded track balise ID and for requesting the signal aspect of the track section in a CBTC track control center.

Compared to approaches 1 to 3 described above the particular advantage is that neither radio balises nor track signals nor on-board CBTC equipment are necessary. In addition, the error rate, which in particular in the case of the first approach is especially large because of the "human factor", is reduced to a minimum. Equipping all maintenance and construction vehicles with on-board CBTC devices in accordance with the third approach is furthermore disadvantageous as regards a lack of compatibility with other track-side train control systems.

The inventive app support additionally has the advantage that a fallback option for CBTC vehicles is readily available if the on-board CBTC device is faulty or has failed.

The app sends the vehicle driver the signal aspect for example in a similar manner to a light signal, wherein "green" means movement authority issued and "red" means movement authority refused, without the potential for error of the human factor. To this end the location of the rail vehicle is initially established, in that the app takes a picture of the next track balise on the CBTC track by means of the smartphone's camera. The term "track balise" here subsumes all kinds of location markings, for example including marker boards or announcement boards for marker boards. Track balises are normally distributed along the stretch of track in the manner of motorway kilometer markers. Each track balise is characterized by a particular ID in the form of a visually identifiable signature. The app evaluates the visual signature and sends the track balise ID to the CBTC track control center, which on the basis of the track balise ID determines the associated track section from a tabular record. This track section information can additionally or alternatively also be determined by the app and transmitted to the CBTC track control center, preferably by radio. A computer in the CBTC track control center determines the vacant or occupied state for the track section and returns the associated signal aspect to the app, which displays this signal aspect on the smartphone.

According to further feature it is provided that the determination of the track balise ID takes place in accordance with step B) by reading a track-balise-specific QR code. The QR code is particularly suitable as a signature of the track balise because it can be readily recognized and it can be easily evaluated photographically. But other signatures, for example marker board IPs or kilometer indicators on kilometer markers, can be recorded photographically and read by the app.

In a preferred embodiment according to a further feature, the track balise ID is sent in accordance with step C) and the signal aspect is received in accordance with step D) via a public communication network. If available, the use of a GSM-R network provided especially for the safety requirements of rail traffic should be preferred; however, public communication networks such as GSM and fixed network are essentially always available at every location.

According to a further feature it is provided that the transmission of the track balise ID in accordance with step C), the receipt of the signal aspect in accordance with step D) and the data processing by the app and the display of the signal aspect on the smartphone take place taking safety-related methods into account.

In particular when using a public communication network, in which safety is particularly jeopardized by undesired interventions, for example hacker attacks, the app for example causes encryption methods, safety protocols or authentication methods to be performed automatically.

On the other hand, thanks to special safety-related methods, for example diversified transmission as text and image information, the protection against technical malfunctions is also improved.

In this way signaling safety can be achieved on CBTC tracks even for rail vehicles which themselves are not equipped with on-board CBTC devices.

The invention claimed is:

1. A method of determining a signal aspect representing a vacant or an occupied state of a track section for a rail vehicle, on a communication-based train control track, wherein the rail vehicle does not have an on-board CBTC device, the method comprising:

initiating the following steps with a software application running on a smartphone:

A) photographing a track balise located in a direction of travel of the rail vehicle;

B) determining an identification signature of the track balise;

C) sending the ID of the track balise to a CBTC track control center, wherein the CBTC track control center determines the signal aspect for the track section that starts with the track balise; and D) receiving the signal aspect determined by the CBTC track control center for the track section starting with the track balise.

2. The method according to claim 1, wherein the rail vehicle is a maintenance or construction vehicle that is not equipped with an on-board CBTC device.

3. The method according to claim 1, wherein the step of determining the ID of the track balise comprises reading a track-balise-specific Quick Response code.

4. The method according to claim 1, wherein the step of sending the track balise ID and the step of receiving the signal aspect are performed by communicating via a public communication network.

5. The method according to claim 1, which comprises sending the track balise ID in step C), receiving the signal aspect in step D), processing the data by the app and displaying the signal aspect on the smartphone taking safety-related methods into account.

6. A device for performing the method according to claim 1, comprising:

a software application to be activated by way of a smartphone for determining a track section on which to travel based on a photographically recorded identification signature of a track balise;

said app being configured for requesting a signal aspect of the track section from a communication-based train control track control center.

* * * * *